United States Patent [19]

Yamamoto et al.

[11] Patent Number: 4,826,410

[45] Date of Patent: May 2, 1989

[54] COOLING SYSTEMS FOR ROTARY PISTON ENGINES

[75] Inventors: Nobuhiro Yamamoto; Noriyuki Kurio, both of Hiroshima, Japan

[73] Assignee: Mazda Motor Corporation, Hiroshima, Japan

[21] Appl. No.: 900,408

[22] Filed: Aug. 26, 1986

[30] Foreign Application Priority Data

Aug. 28, 1985 [JP] Japan ..... 60-131308[U]

[51] Int. Cl.[4] ..... F01C 21/06; F01P 3/22; F01P 11/02

[52] U.S. Cl. ..... 418/84; 418/85; 418/88; 123/41.54

[58] Field of Search ..... 418/83, 84, 85, 87, 418/88; 123/41.44, 41.54

[56] References Cited

U.S. PATENT DOCUMENTS

| | | | |
|---|---|---|---|
| 3,572,984 | 3/1971 | Jones | 123/41.54 |
| 3,907,468 | 9/1975 | Green et al. | 418/83 |
| 4,237,848 | 12/1980 | Korzhov et al. | 123/242 |
| 4,554,891 | 11/1985 | Hayashi | 123/41.44 |

FOREIGN PATENT DOCUMENTS 50-4105 1/1975 Japan .

*Primary Examiner*—John J. Vrablik

*Attorney, Agent, or Firm*—Fleit, Jacobson, Cohn & Price

[57] ABSTRACT

A cooling system for a rotary piston engine including a radiator and a cooling liquid pump for forcing the cooling liquid to flow through the cooling liquid passages in the engine. The engine has a front cover provided at the axially front end of the engine for supporting accessories such as lubricant oil pump and an ignition distributor. The cooling liquid pump is provided in the front cover and connected with the cooling liquid passage in the engine through a supply passage which is also formed in the front cover.

9 Claims, 4 Drawing Sheets

COOLING SYSTEMS FOR ROTARY PISTON ENGINES

BACKGROUND OF THE INVENTION

1. Field of the Invention

The present invention relates to rotary piston engines, and more particularly to cooling systems for rotary piston engines. More specifically, the present invention pertains to cooling systems for rotary piston engines wherein cooling liquid pumps are provided to force cooling liquid through cooling liquid jackets formed in the rotary piston engines.

2. Description of the Prior Art

In Japanese utility model application No. 48-56369 filed on May 14, 1973 and published for public inspection on Jan. 17, 1975 under the disclosure No. 50-4105, there is disclosed an example of the cooling system for a rotary piston. In the structure disclosed by this Japanese utility model, a cooling liquid pump is provided on the upper portion of one of the side housings so that the cooling liquid is drawn from the radiator and forced to flow through the cooling liquid jackets in the engine.

It should however be noted that in the structure of this utility model, since the cooling liquid pump is located at the upper portion of the engine, there is a possibility that air will be drawn into the pump when the level of the cooling liquid is decreased. This trend is particularly significant in a car of recent design having a lower front profile which causes a decrease in the heightwise dimension of the front engine compartment. In this type of car, an inclined radiator arrangement is usually adopted for accommodating the radiator to the front engine compartment of decreased height, so that the cooling liquid pump is very often located above the level of the radiator and there is a high possibility that air will be drawn into the pump in a case where the pump is located at an upper portion of the engine.

If air is drawn into the cooling liquid pump, there will be a decrease in the cooling effect of the cooling liquid. Further, in a case where the level of the cooling liquid is decreased in the pump, the pump impeller will be exposed in the air space so that the pump efficiency will significantly be decreased. It should further be noted that in a structure where the pump is mounted directly on the engine casing, there will be a danger of pump overheating if the level of the cooling liquid is decreased in the pump. Thus, it is undoubtedly preferable to locate the cooling liquid pump at a lower portion of the engine. However, it is very difficult to find a proper location for the pump.

In an engine having a cover plate provided outside one of the side housings for mounting engine accessories such as a lubricant oil pump and an ignition distributor, the cooling liquid pump may be mounted on this cover plate and it may be possible to locate the cooling liquid pump at a lower portion if the pump is mounted on an outer side face of the cover plate. However, this arrangement is disadvantageous in that the overall length of the engine is undesirably increased so that inconveniencies may be encountered in arranging the engine in the engine compartment. Particularly, the problem becomes serious in a rotary piston engine having three or more rotors which has an increased axial length as compared with conventional commercial rotary piston engines.

SUMMARY OF THE INVENTION

It is therefore an object of the present invention to provide a cooling system for a rotary piston engine wherein the cooling liquid pump can be conveniently located at a lower portion of the engine.

Another object of the present invention is to provide a cooling system for a rotary piston engine in which a cooling liquid passage can be conveniently provided for passing the liquid from a liquid pump provided at a lower portion of the engine to an upper portion of the engine to thereby introduce the liquid into the engine cooling liquid jackets.

According to the present invention, the above and other objects can be accomplished by a rotary piston engine including casing means, rotor means disposed in said casing means and supported by a shaft extending in an axial direction through said casing means, said casing means being formed with cooling liquid passage means, cooling liquid pump means provided at an axial end portion of the casing means and adapted to be driven by said shaft, radiator means for cooling the cooling liquid, cooling liquid supply conduit means for connecting said pump means with said cooling liquid passage means in said casing means, return conduit means for connecting said cooling liquid passage means in said casing means with said radiator means, suction conduit means for connecting said radiator means with said pump means, whereby the cooling liquid is drawn by the pump means from the radiator means and supplied through the supply conduit means to the cooling liquid passage means in said casing means and then returned through the return conduit means to the radiator means, the improvement comprising cover plate means provided at one axial end of the casing means, said cooling liquid pump means being provided at a lower portion of said cover plate means and having outlet port means, said cooling liquid supply conduit means being formed integrally with said cover plate means to extend from said outlet port means of said pump means upwardly along a side of the shaft to an upper portion of the cover plate means and connected with said cooling liquid passage means in said casing means. In a preferable aspect of the present invention, bypass conduit means is formed integrally with the cover plate means to connect the cooling liquid passage means in said casing means with inlet port means of said pump means to provide a bypass conduit bypassing the radiator means, said bypass conduit means being provided with thermostatic means for controlling cooling liquid flow through said bypass passage means in accordance with engine temperature.

According to the features of the present invention, the cooling liquid pump means can always be maintained below the level of the cooling liquid, so that it is possible to prevent air from being drawn into the pump means even when the cooling liquid level is decreased due to possible evaporation of the cooling liquid. Since the cooling liquid pump means is located away from the engine casing, it is possible to avoid direct heat transfer from the engine to the pump. By forming the cooling liquid pump in the cover plate means, it becomes possible to locate the cooling liquid pump at a lower portion without substantially increasing the axial length of the engine. According to the present invention, the cover plate means is of an increased thickness. This is advantageous in that the noise blocking effect of the cover plate can be increased.

The above and other objects of the present invention will become apparent from the following description of preferred embodiments taking reference to the accompanying drawings.

DESCRIPTION OF THE PREFERRED EMBODIMENTS

Figure 1:
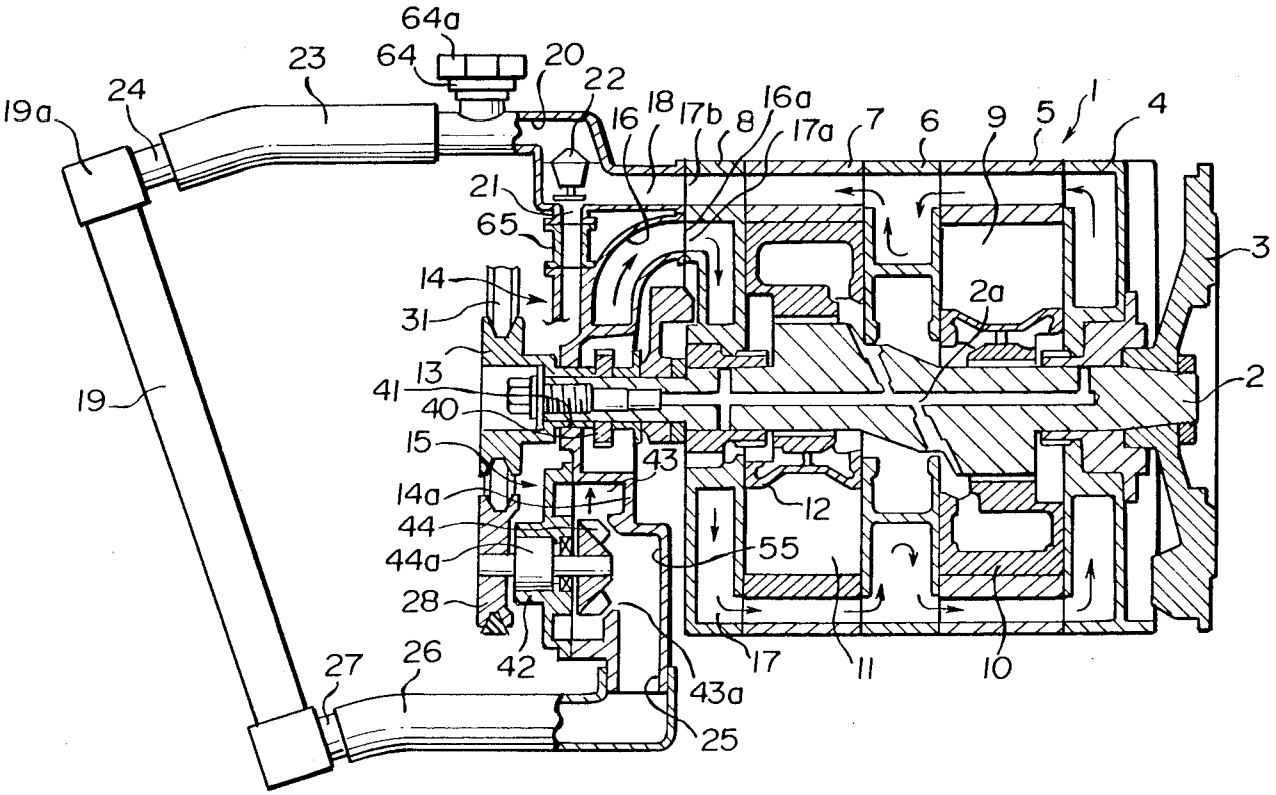
FIG. 1 is a sectional view of a rotary piston engine in accordance with one embodiment of the present invention.

Referring now to the drawings, particularly to FIG. 1, there is shown a two-rotor type rotary piston engine 1 including rotor housings 5 and 7 which are connected together with an intermediate housing 6 interposed therebetween. A side housing 4 is attached to the outer surface of the rotor housing 5 and a side housing 8 is attached to the outer surface of the rotor housing 7. Thus, the rotor housings 5 and 7 and the housings 4, 6 and 8 constitute a rotor casing including a rotor cavity 9 which is of a trochoidal configuration and defined by the housings 4, 5 and 6 and a rotor cavity 11 which is also of a trochoidal configuration and defined by the housings 6, 7 and 8. In the rotor cavity 9, there is disposed a rotor 10 of a triangular configuration which is rotatable with apex portions in sliding contact with the inner wall surface of the rotor housing 5. Similarly, in the rotor cavity 11, there is disposed a rotor 12 of a triangular configuration for rotation with apex portions in sliding contact with the inner wall of the rotor housing 7. The rotors 10 and 12 are supporting by an eccentric shaft 2 which extends outwards through the side housings 4 and 8. At the end adjacent to the side housing 4, the eccentric shaft 4 is attached with a flywheel 3. The eccentric shaft 2 is formed with an axially extending oil passage 2a for passing lubricant oil to bearings for the shaft 2.

Figure 2:
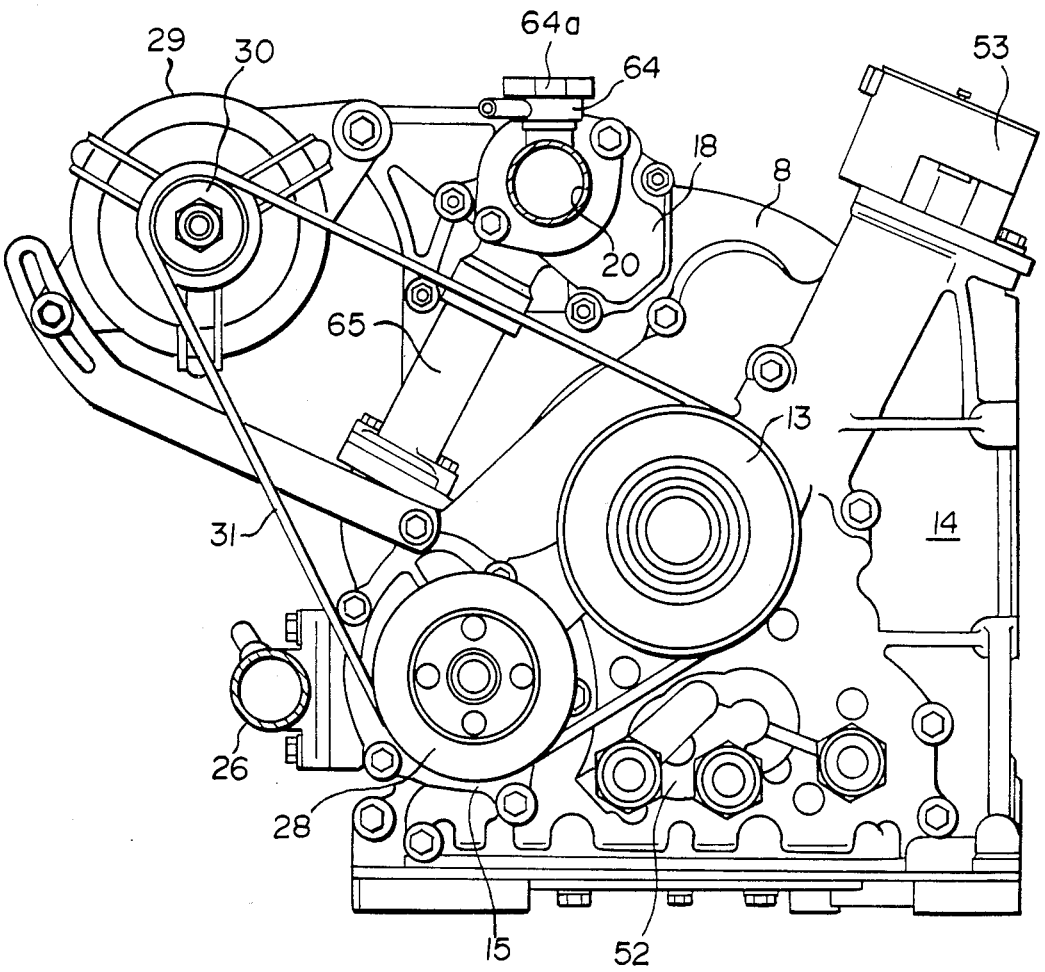
FIG. 2 is a front view of the rotary piston engine shown in FIG. 1.

At the other end, the eccentric shaft 2 carries a front cover 14 which is adapted for mounting a lubricating oil pump 52 and an ignition distributor 53 as shown in FIG. 2. The eccentric shaft 2 is provided with a gear 40 for driving the oil pump 52 and the distributor 53. The eccentric shaft 2 passes through an opening 41 formed in the front cover 14 and a driving pulley 13 is attached to the outer end of the eccentric shaft 2. Beneath the eccentric shaft 2, the front cover 14 is provided with a cooling liquid pump 15. The cooling liquid pump 15 is comprised of a pump chamber 43 defined by a pump housing section 14*a* integrally formed in the front cover 14 and a pump cover 42 attached to the front cover 14. An impeller 44 is disposed in the pump chamber 43. The impeller 44 has an impeller shaft 44*a* which extends through the pump cover 42 and a driven pulley 28 is attached to the outer end of the impeller shaft 44*a*. As shown in FIG. 2, the front cover 14 further supports an alternator 29 which has a driven shaft provided with a driven pulley 30. A power transmitting belt 31 is stretched around the pulleys 13, 28 and 30 so that the rotation of the eccentric shaft 2 is transmitted to the pulleys 28 and 30 to drive the pump impeller 44 and the alternator 29.

Figure 3:
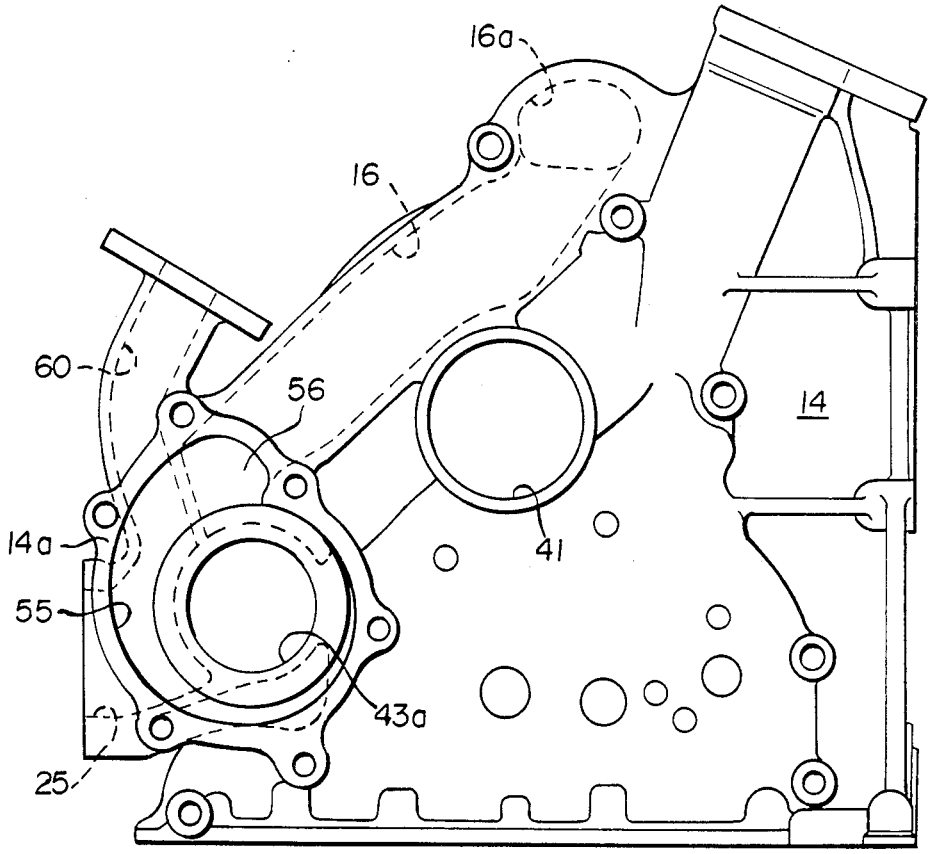
FIG. 3 is a front view of the front cover plate used in the engine shown in FIG. 2; and, FIG. 4 is a fragmentary sectional view showing another embodiment of the present invention.

As shown in FIG. 3, the pump housing section 14*a* has a cavity 55 which constitutes a part of the pump chamber 43 and an outlet port 56 is provided in the cavity 55. It will further be noted in FIG. 3 that the front cover 14 is formed with a cooling liquid supply passage 16 which extends obliquely upwards by the opening 41 for the eccentric shaft 2. At the upward end 16*a*, the passage 16 is connected with an inlet port 17*a* of a cooling liquid passage 17 formed in the side housing 8.

In FIG. 3, it will further be noted that the cavity 55 has an inlet port 43*a* and a suction passage 25 is integrally formed in the front cover 14 to communicate with the inlet port 43*a*. A bypass passage 60 is formed to communicate at one end with the suction passage 25 which is in turn connected through a flexible hose 26 with an outlet port 27 of a radiator 19. The cooling liquid passage 17 in the engine casing has an outlet port 17*b* to which a return passage 18 is connected. In this embodiment, the return passage 18 is formed separately from the front cover 14 and provided with a return port 20 and a bypass port 21. The return passage 18 is provided with a thermostatic valve 22 which functions to direct the liquid from the cooling liquid passage 17 in the engine either to the return port 20 or to the bypass port 21 depending on the temperature of the cooling liquid. At the return port 20, the return passage 18 is provided with a cooling liquid filler port 64 which is closed by a filler cap 64*a*. The bypass port 21 is connected with a bypass pipe 65 which is in turn connected with the bypass passage 60 shown in FIG. 3.

The return port 20 is connected through a flexible hose 23 with an inlet port 24 of the radiator 19. As shown in FIG. 1, the radiator 19 is forwardly inclined in order to accommodate the radiator to an engine compartment of a decreased heightwise dimension. In this arrangement, the upper portion of the radiator 19 is located below the upper portion of the engine so that the cooling liquid pump 15 is likely to be located above the upper portion of the radiator 19 causing a possibility that air is drawn into the cooling liquid pump. According to the arrangement described above, however, the cooling liquid pump 15 is provided at a lower portion of the front cover 14 so that it is possible to prevent air from being drawn in the cooling liquid pump. It should further be pointed out that the cooling liquid pump 15 is formed integrally in the front cover 14, so that the cooling liquid pump can be arranged without increasing the axial dimension of the engine assembly. Since the cooling liquid supply passage is also formed in the front cover 14, the conduit arrangement for the engine cooling system can be simplified.

In operation, the cooling liquid is pumped by the pump 15 to flow through the supply passage 16 formed in the front cover 14 into the cooling liquid passage 17 in the engine. The cooling liquid then flows through the passage 17 and leaves the passage 17 at the outlet port 17b to flow into the return passage 18. At the return passage 18, the cooling liquid is directed depending on the temperature either to the return port 20 to be returned to the radiator 19 or to the bypass port 21 to be introduced again to the cooling liquid pump 15.

Referring to FIG. 4 which shows another embodiment of the present invention, the structure is basically the same as that in the previous embodiment so that corresponding parts are designated by the same reference numerals as in the previous embodiment. This embodiment is different from the previous embodiment in that the return passage 18 is formed integrally in the front cover 14. The return passage 18 is located directly above the cooling liquid supply passage 16 and a deaerating hole 32 is formed between the passages 16 and 18. The return passage 18 has a bypass port 21 which is connected with a bypass passage 65 which is also formed in the front cover 14. The return passage 18 also has a return port 20 which is connected with a return hose 23 as in the previous embodiment.

The invention has thus been shown and described with reference to preferred embodiments, however, it should be noted that the invention is in no way limited to the details of the illustrated structures but changes and modifications may be made without departing from the scope of the appended claims.

We claim:

1. A rotary piston engine including casing means having rotor housing means and side housing means, rotor means disposed in said casing means, a shaft extending in an axial direction through said casing means and supporting said rotor means, said casing means being formed with cooling liquid passage means, cooling liquid pump means provided at an axial end portion of the casing means and adapted to be driven by said shaft to pump cooling liquid through said casing means, radiator means for cooling the cooling liquid, cooling liquid supply conduit means for connecting said pump means with said cooling liquid passage means in said casing means, return conduit means for connecting said cooling liquid passage means in said casing means with said radiator means, suction conduit means for connecting said radiator means with said pump means, so that the cooling liquid is drawn by the pump means from the radiator means and supplied through the supply conduit means to the cooling liquid passage means in said casing means and then returned through the return conduit means to the radiator means, cover plate means provided at one axial end of the casing means and separated from said side housing means, said cooling liquid pump means being provided at a lower portion of said cover plate means and having outlet port means, said cooling liquid supply conduit means being formed integrally with said cover plate means to extend from said outlet port means of said pump means upwardly in the vicinity of the shaft to an upper portion of the cover plate means and connected with said cooling liquid passage means in said casing means at an upper portion of said cooling liquid passage means to introduce the cooling liquid downwardly into said casing means.

2. A rotary piston engine in accordance with claim 1 in which said cooling liquid pump means includes pump housing means formed in said cover plate means and having said outlet port means which is directly connected with said cooling liquid supply conduit means.

3. A rotary piston engine in accordance with claim 2 in which said pump housing means has inlet port means, said suction conduit means including suction passage means formed in said cover plate means and connected with said inlet port means.

4. A rotary piston engine in accordance with claim 1 in which bypass conduit means is provided to connect the return conduit means with said cooling liquid pump means, thermostatic valve means being provided in said return conduit means for directing cooling liquid to said radiator means and said cooling liquid pump means depending on temperature of the cooling liquid.

5. A rotary piston engine in accordance with claim 1 in which said cooling liquid supply conduit means is provided at an upper portion with deaerating means.

6. A rotary piston engine in accordance with claim 5 in which said return conduit means is formed in said cover plate means directly above the cooling liquid supply conduit means, said deaerating means being a hole formed between said cooling liquid supply conduit means and said return conduit means.

7. A rotary piston engine in accordance with claim 1 in which said cooling liquid pump means is provided in said cover plate means at a portion sidewardly offset from said shaft of the engine, said cooling liquid supply passage means being extending substantially upwardly by the shaft of the engine and connected at an upper end with inlet port means of said cooling liquid passage means in said casing means of the engine, said suction conduit means being also formed in said cover plate means, said cover plate means being further formed with bypass conduit means for connecting said return conduit means with said suction conduit means.

8. A rotary piston engine in accordance with claim 1 in which said cooling liquid pump means includes housing means formed in said cover plate means at a lower portion of the cover plate means, said cooling liquid supply conduit means being extending upwards from said housing means at a side of said shaft of the engine to be connected at an upper end with the cooling liquid passage means in said casing means of said engine, said return conduit means being formed in said cover plate means at an upper portion thereof, said return conduit means being located directly above the cooling liquid supply conduit means, deaerating hole means being formed between the return conduit means and the cooling liquid supply conduit means, said suction conduit means being formed in said cover plate means at a lower portion of the cover plate means, said cover plate means being further formed with bypass conduit means connecting said return conduit means with said suction conduit means, thermostatic valve means provided in said return conduit means for directing cooling liquid to said radiator means and to said cooling liquid pump means depending on temperature of the cooling liquid.

9. A rotary piston engine in accordance with claim 2 in which said radiator means being inclined in fore-and-aft direction so that an upper portion of the radiator means is located lower than an upper end portion of the engine.

* * * * *